United States Patent [19]

Crowell

[11] Patent Number: 4,742,977

[45] Date of Patent: May 10, 1988

[54] WING STRUCTURE WITH SELF-INDUCED CAMBER

[76] Inventor: Robert L. Crowell, Rte. 6, Box 473B, Boone, N.C. 28607

[21] Appl. No.: 934,828

[22] Filed: Nov. 25, 1986

Related U.S. Application Data

[63] Continuation-in-part of Ser. No. 925,923, Nov. 3, 1986, abandoned.

[51] Int. Cl.[4] ..... B64C 3/22

[52] U.S. Cl. ..... 244/123; 244/153 R; 244/900; 244/16

[58] Field of Search ..... 244/900–904, 244/16, 123, 13

[56] References Cited

U.S. PATENT DOCUMENTS

| | | | |
|---|---|---|---|
| 3,924,870 | 12/1975 | Spivack et al. . | |
| 3,954,235 | 5/1976 | Powell . | |
| 4,116,406 | 9/1978 | Hamilton | 244/901 |
| 4,248,394 | 2/1981 | Klumpp | 244/16 |
| 4,382,566 | 5/1983 | Brand | 244/903 |
| 4,415,131 | 11/1983 | Bertelsen et al. | 244/123 |
| 4,458,859 | 7/1984 | Ganev | 244/16 |
| 4,651,665 | 3/1987 | Drake . | |

FOREIGN PATENT DOCUMENTS

| | | | |
|---|---|---|---|
| 2951344 | 6/1981 | Fed. Rep. of Germany | 244/16 |
| 1583467 | 1/1981 | United Kingdom | 244/900 |

OTHER PUBLICATIONS

Stang, "The Amateur Scientist", Dec. 1974, *Scientific American.*

*Primary Examiner*—Galen Barefoot

*Attorney, Agent, or Firm*—James W. Hellwege

[57] ABSTRACT

An improved wing structure is provided having a self-induced camber. The wing comprises an aerodynamic dihedral sail structure having a fabric sail tensioned on a supporting frame comprised of lateral brace members and a longitudinal member intermediate the ends of the lateral braces. The tensioning of the sail and the configuration of the supporting frame is such that the sail assumes a dihedral shape, with the sail being caused to assume a tensioned or stressed condition along a portion of the leading edge of the sail intermediate the respective lateral ends of the sail resulting in the formation of a self-induced camber at that location.

28 Claims, 5 Drawing Sheets

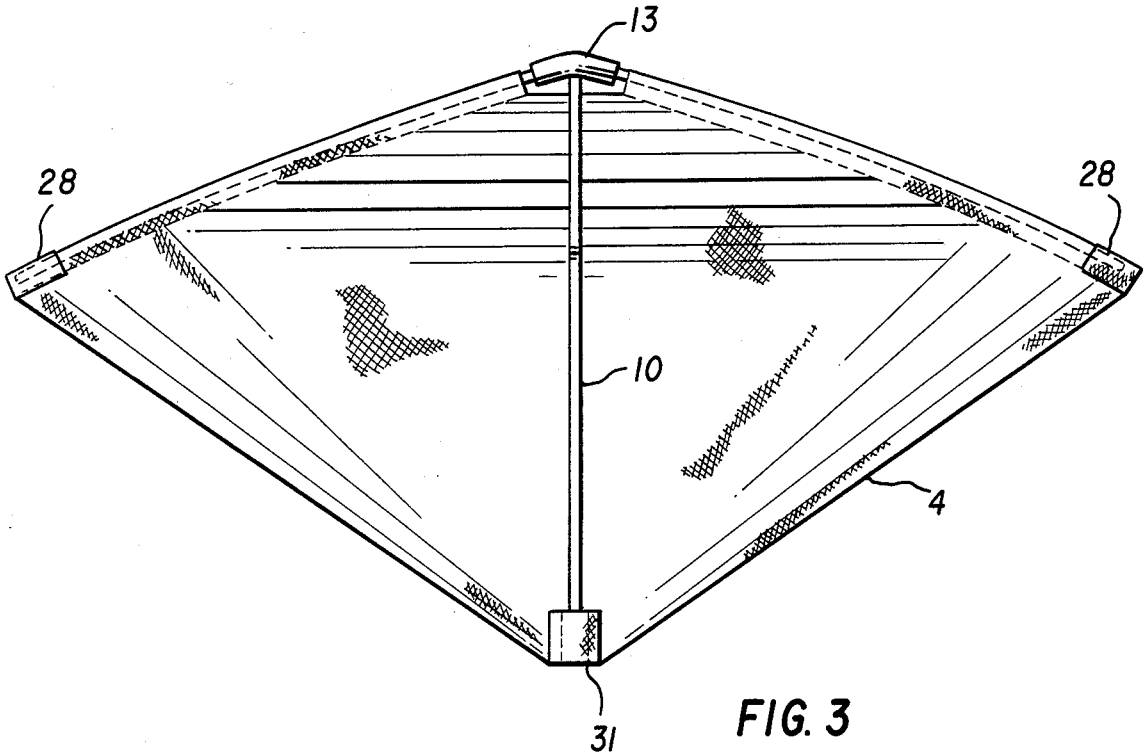
FIG. 3
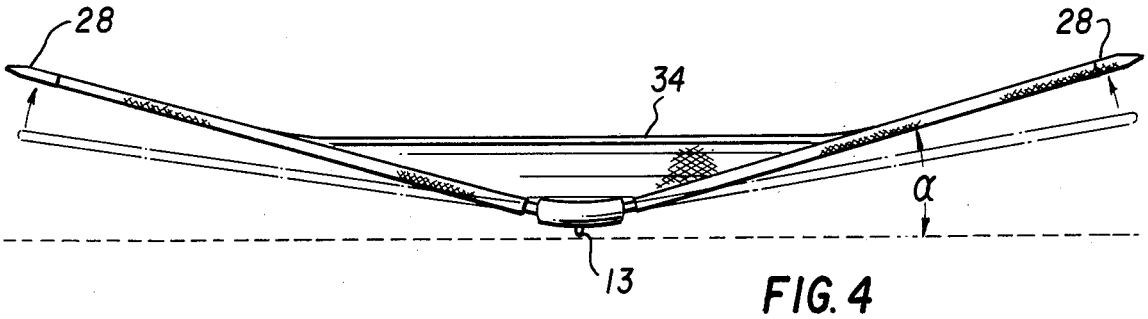
FIG. 4
FIG. 5
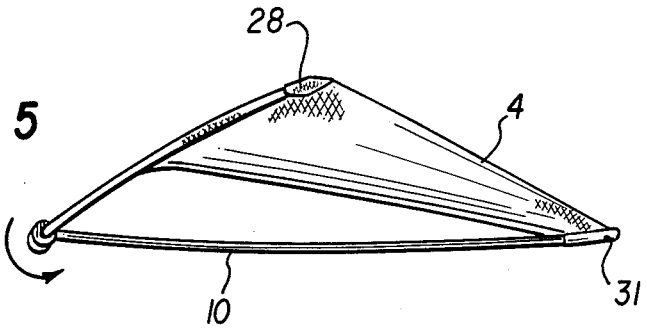

WING STRUCTURE WITH SELF-INDUCED CAMBER

REFERENCE TO RELATED APPLICATIONS

The present application is a continuation-in-part application of application Ser. No. 925,923, filed Nov. 3, 1986, now abandoned.

BACKGROUND OF THE INVENTION

The present invention relates to an improved dihedral wing having a self-induced camber portion.

Dihedral wings have been employed for a long period of time and have both taken many forms and been adapted to various uses. For example, U.S. Pat. No. 3,954,235 discloses a dihedral kite wing and U.S. Pat. No. 3,898,763 discloses a dihedral model aircraft wing.

Related wing structures (although not dihedral in configuration) are disclosed in U.S. Pat. Nos. 2,793,870; 3,768,823; 3,924,870; 4,136,631; 4,186,680 and 4,473,022 which disclose various forms of hand-held sail structures designed for the propulsion of a person. Additionally, U.S. Pat. Nos. 2,784,524; 2,896,370; 2,932,124; 3,246,425; 3,943,657; 3,949,519; and 4,458,442 are each directed to various types of toy glider wings.

However, one disadvantage with respect to such known prior art wings is the desire to enhance the lift characteristics of the wing without disadvantageously increasing the mass or weight of the wing. It has also not heretofore been possible to provide such increased lift by means of a camber portion at the leading edge of the wing without the necessity for prestressed structural members within the wing itself. The presence of such members undesirably increases the weight of the wing while also enhancing the possibility of damage to that portion of the wing upon forceful impact.

OBJECTS AND SUMMARY OF THE INVENTION

It is accordingly an object of the present invention to provide an improved wing having a self-induced camber portion.

It is also an object of the present invention to provide an improved wing which avoids the need for the use of prestressed members to induce the formation of a camber in a fabric sail.

It is further an object of the present invention to provide an improved wing which exhibits enhanced lift as a result of the presence of an induced camber.

It is also an object of the present invention to provide a wing of enhanced durability as a result of minimizing the presence of structural members within the wing.

In accordance with the present invention there is thus provided an improved wing having a self-induced camber comprising an aerodynamic dihedral sail structure comprising a fabric sail tensioned on a supporting frame, said supporting frame comprised of elongated lateral brace members at least along the leading edge of the wing and an elongated longitudinal brace member positioned intermediate the ends of the lateral braces, said lateral brace members and said longitudinal brace member being attached to one another at a centrally disposed terminus on the leading edge of the wing, said lateral brace members and said longitudinal brace member being sufficiently flexible to permit tensioning thereof, said sail being attached to said lateral brace members and to the rearward extent of said longitudinal brace member, said sail being so configured and said lateral and longitudinal brace members attached in a manner resulting in said sail being tensioned over said supporting structure in a manner sufficient to result in the formation of an induced camber intermediate the lateral ends of the sail and adjacent a centrally disposed portion of the leading edge of the wing.

BRIEF DESCRIPTION OF THE DRAWINGS

FIG. 3 is a bottom view of the embodiment of the improved wing of the present invention depicted in FIG. 1.

FIG. 4 is a front view of the embodiment of the improved wing of the present invention depicted in FIG. 1.

FIG. 5 is a side view of the embodiment of the improved wing of the present invention depicted in FIG. 1.

DETAILED DESCRIPTION OF THE PRESENT INVENTION

The improved wing of the present invention comprises in its most important aspect a self-induced camber or convex curve of an airfoil at a centrally disposed portion of the leading edge of the wing. Such camber is self-induced and achieved without the use of prestressed structural members positioned within the sail portion of the wing. Instead, the self-induced camber within the sail portion of the wing is achieved totally by interaction and cooperation of both the sail and the supporting structure of the wing which support the sail.

The present invention will be described in conjunction with the accompanying Figures with like elements being depicted with identical numbers.

As depicted in FIGS. 1–5, the improved wing of the present invention comprises in one embodiment an aerodynamic dihedral sail structure 1 having a fabric sail 4 (shown in phantom in FIG. 1 to permit viewing of the supporting structure) tensioned on a supporting frame. The supporting frame comprises elongated lateral brace members 7 at least along the leading edge of the wing and an elongated longitudinal brace member 10 centrally positioned intermediate the lateral ends of the lateral brace members. The lateral brace members 7 and the longitudinal brace member 10 are attached to one another at a centrally disposed terminus or point of attachment located on the leading edge of the wing. The lateral brace members and the longitudinal brace member are sufficiently flexible to permit tensioning thereof. The fabric sail 4 is attached to the lateral brace members and to the rearward (or trailing) portion of the longitudinal brace member, and the sail being so configured and the lateral and longitudinal brace members being attached to one another in a manner such that the sail is tensioned over the supporting structure in a manner sufficient to result in the formation of a dihedral wing having an induced camber intermediate the lateral ends of the sail and adjacent a centrally disposed portion of the leading edge of the wing.

Figure 1:
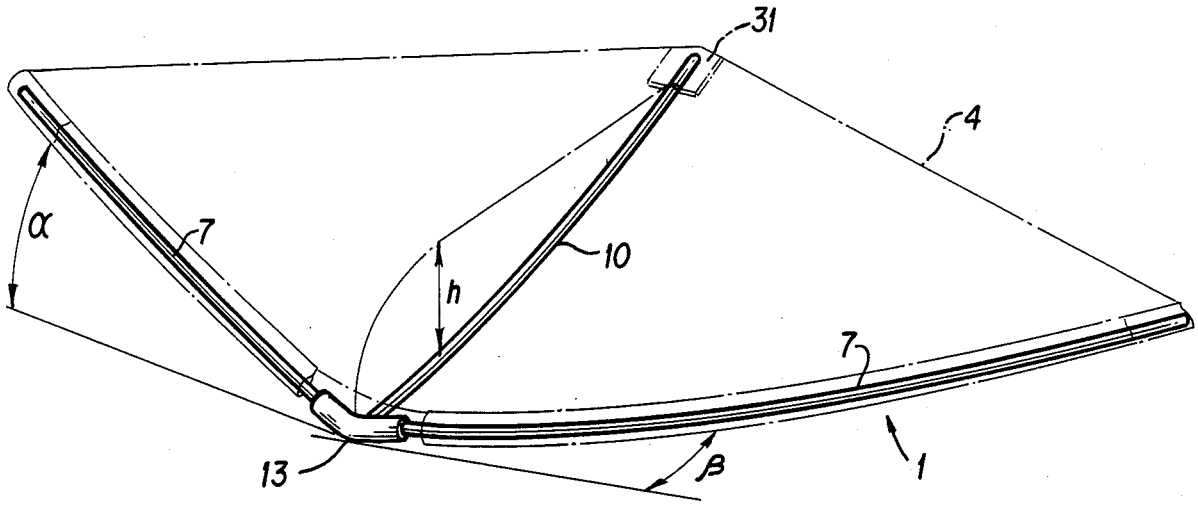
FIG. 1 is a front perspective view of one embodiment of the improved wing of the present invention.
Figure 2:
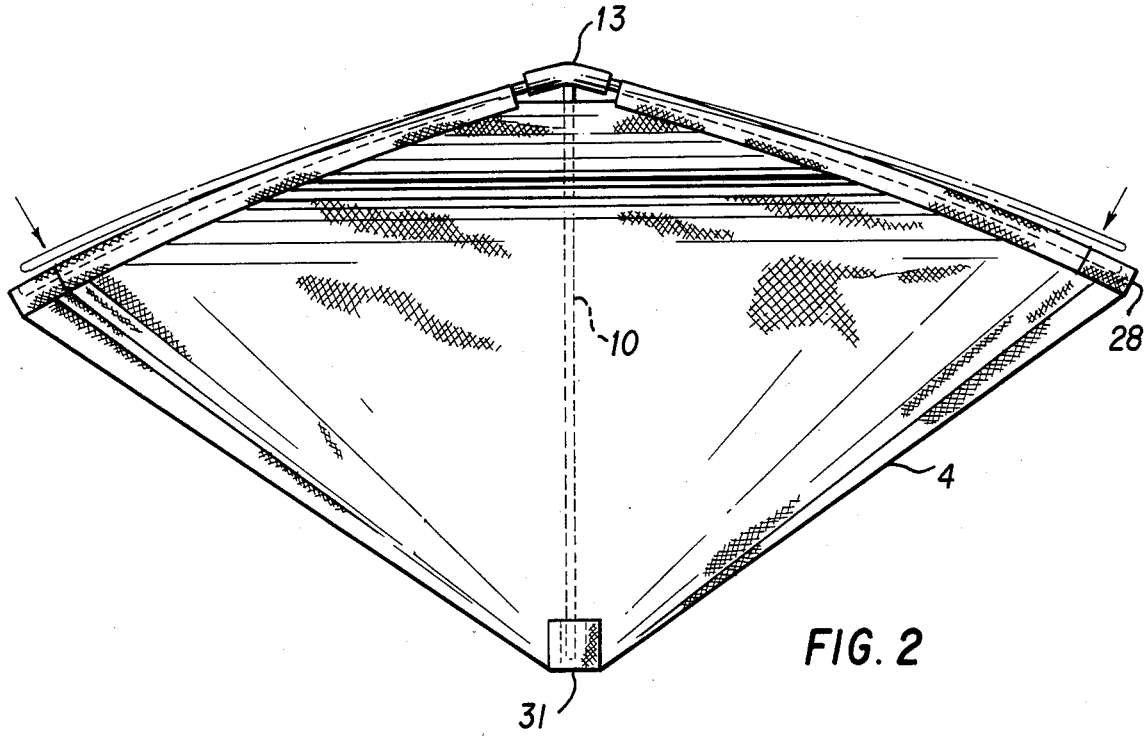
FIG. 2 is a top view of the embodiment of the improved wing of the present invention depicted in FIG. 1.

Preferably, the wing includes a dihedral angle ranging from greater than 0 degrees up to about 45 degrees, as measured in a vertical plane from a line horizontally disposed to the foremost leading portion of the wing to a line coextensive with the leading edge of the wing as depicted as angle alpha in FIGS. 1 and 4. Most preferably, the dihedral angle ranges from about 5 to about 20 degrees.

The improved wing of the present invention preferably includes a sweep angle of from about 0 to about 60 degrees as measured in a horizontal plane from a line vertically disposed to the foremost leading portion of the wing to a line coextensive with the leading edge of the wing as depicted as angle beta in FIG. 1. Preferably, the sweep angle ranges from about 25 to about 45 degrees. The maximum sweep angle employed is dependent upon the ultimate use of the wing, with kites being able to employ a sweep angle of up to 60 degrees while glider wings generally employ a maximum sweep angle of about 45 degrees.

The improved wing of the present invention includes a self-induced camber having a height or vertical extent h as depicted in FIG. 1. The camber is preferably of greatest vertical extent adjacent the leading edge of the wing and gradually diminishes in vertical extent in the direction of the trailing edge of the wing in a manner consistent with conventional airfoil configurations. The maximum height or vertical extent of the self-induced camber is determined by the maximum dihedral angle of the wing.

The positioning of the maximum height or vertical extent of the camber along the extent of the intermediate longitudinal brace member may be modified by the angle of sweep of the lateral ends of wing. That is, the greater the degree of sweep of the lateral ends of the wing the further the maximum height or vertical extent of the camber may be positioned from the leading edge of the wing.

Figure 10:
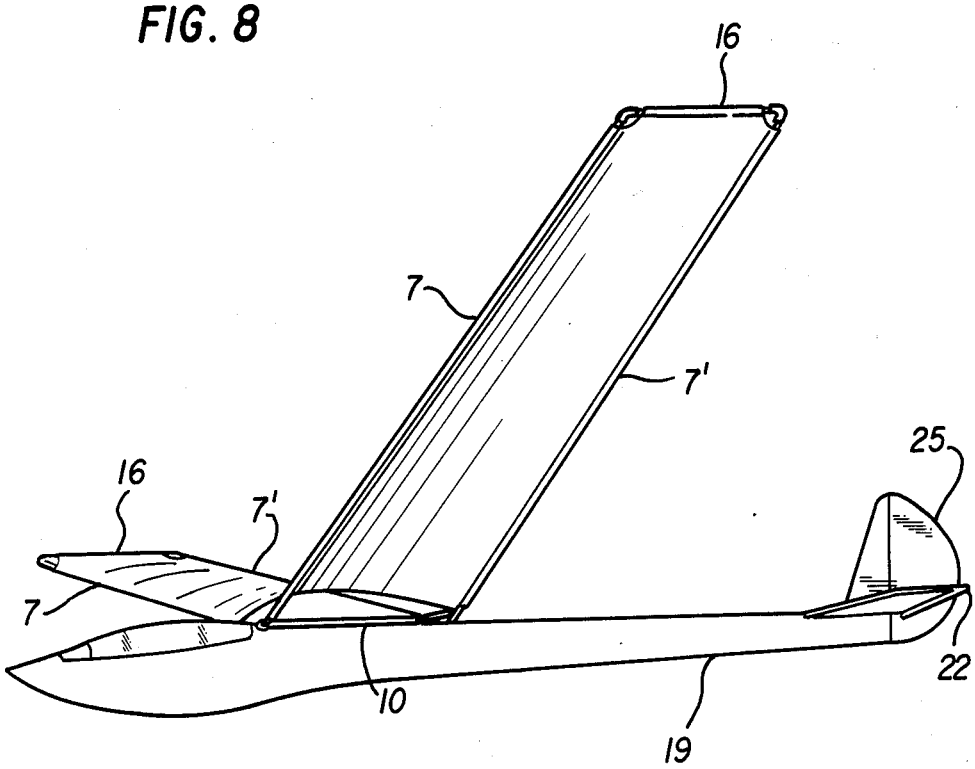
FIG. 10 is a view in perspective of a hand-tossed glider comprising a second embodiment of the improved wing of the present invention.
Figure 11:
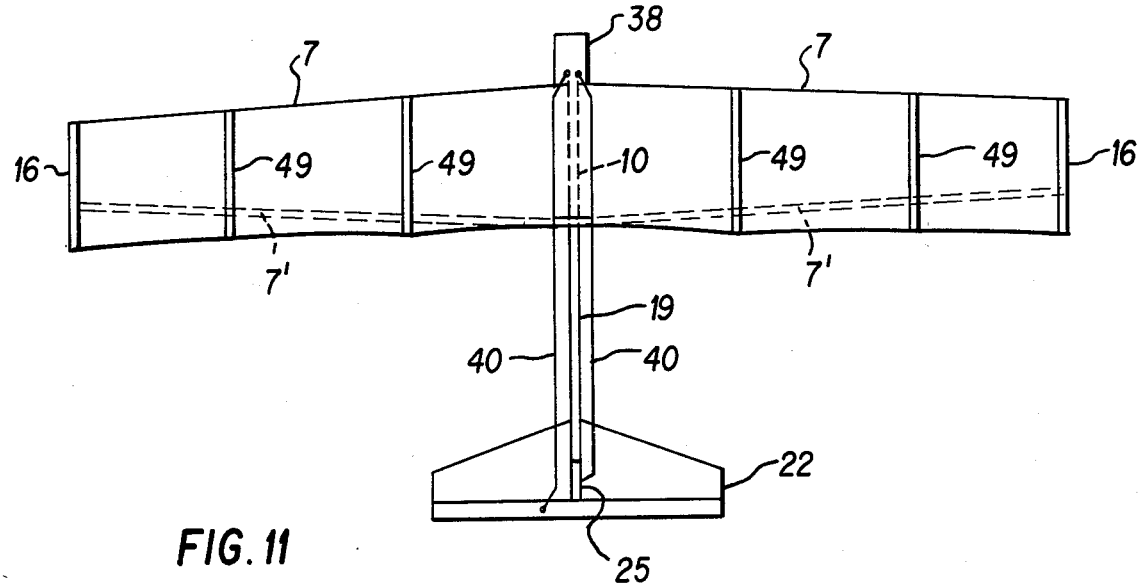
FIG. 11 is a top view of a radio-controlled glider comprising a third embodiment of the improved wing of the present invention.

Generally the self-induced camber portion 34 of a sail as depicted in FIGS. 1–9 will extend in the lateral direction from the point of attachment of the intermediate longitudinal brace member to the lateral brace members to a point no further than approximately one-third to one-half the distance to the lateral ends of the leading edge of the wing. However, the self-induced camber portion of a wing of the present invention as employed in conjunction with a glider wing such as depicted in FIGS. 10 or 11 will preferably extend virtually from wing tip to wing tip, with a minor portion of the lateral extent of the wings comprising a planar portion.

By contrast, the majority of the wing of the present invention as embodied in FIGS. 1–9 (with the exception of the cambered portion) is substantially planar in configuration. This is believed to be depicted in FIGS. 4 and 9 where the lateral non-cambered portions of the wing are stretched across the lateral braces to form a substantially planar surface, with the cambered portion existing only within the first one-third or so of the lateral extent of the respective wing surfaces.

It has been found desirable for kite wings produced in accordance with the present invention to include a billowed (or non-taut) portion along the trailing edge of the sail to enhance the stability of the kite in flight. The sail of such kites would thus include an induced camber portion along a portion of the leading edge, a substantial laterally-disposed planar surface area and a billowed portion along the trailing edge.

The leading edges of the wing can extend rearwardly from the foremost point of the wing any distance which will not adversely affect the flight dynamics of the wing. In the embodiments depicted, the leading edges extend rearwardly a distance up to approximately one-half the distance from the leading end of the intermediate longitudinal brace member to the rearmost end of the intermediate longitudinal brace member. However, it should also be recognized that the leading edges can under some circumstances extend rearwardly as far as and even beyond the rearmost portion of the intermediate longitudinal brace member depending upon the sweep angle employed and the length of the intermediate longitudinal brace member (i.e., as in a delta wing).

The wing of the present invention is comprised of a fabric sail portion 4 capable of being stretched across the supporting structural members. Such fabric is preferably comprised of a synthetic material such as a nylon, polyester or polyethylene fabric. Conventional sail or kite cloths of varied compositions are suitable. However, any suitable material may be employed, with the type of material which is employed being dependent upon the ultimate use to which the wing is to be put as well as the types of conditions to which the wing will be subjected. For example, the use of the wing as part of a kite or a hand-tossed glider would only necessitate the use of lightweight synthetic fabrics which are inexpensive and relatively durable. The choice of suitable fabrics for the sail is well within the level of skill of the routineer in the art.

The various members of the supporting structure of the wing are comprised of any suitable material which will enable adequate structural support to be provided for the sail while also retaining sufficient flexibility to permit such members to be placed under tension upon assembly of the wing. Such members may suitably be comprised of fiberglass, although metallic materials such as aluminum may be used if the size of the wing becomes significantly large. Such members (depending upon the size required) may be either solid in cross-section or tubular in configuration. The supporting structure for a hand-held sail is preferably comprised of tubular aluminum, while kites may employ fiberglass rods.

As depicted in FIGS. 1–5, the wing of the present invention may be diamond-shaped in configuration, with the sail being of greater dimension in its lateral extent than in its longitudinal extent. However, various other shapes are possible.

For example, the improved wing of the present invention may also be substantially rectangular in configuration as depicted in FIGS. 10 and 11. In such configuration, opposing pairs of lateral brace members 7, 7' are employed which are substantially parallel to one another. Such lateral brace members are attached at one end to the intermediate longitudinal brace member 10 and at another end to laterally disposed longitudinal brace members 16. Even when employed in such a configuration the wing will include a self-induced camber with the wing being dihedral in configuration. Such rectangular type wings are employed with advantage in conjunction with a suitable fuselage member 19 to yield a tossed glider. As depicted in the Figure, the fuselage member 19 may include vertically and horizontally disposed flight stabilizing surfaces 22, 25 located at a rearward extent thereof. Alternatively, the wing may be delta shaped in configuration, with the wing having swept back leading edges.

The improved wing of the present invention (as depicted in FIGS. 1–5) may be assembled or formed as follows. Lateral brace members 7 are positioned within sewn-in tunnelled seams (approximately the same length as the lateral braces) provided along the lateral extent of the leading edge of the sail fabric and seated in sewn-in pockets 28 at the respective lateral end portions of the sail.

The sail fabric depicted in FIGS. 1–6 is approximately diamond-shaped in configuration, having a longitudinal dimension (or cord length) approximately 12 inches at center, a tip to top dimension of approximately 22 inches, and a straight line drawn from tip to tip passing approximately 5.5 inches rearward of the foremost leading edge of the sail. The intermediate longitudinal brace member 10 having a length of 11.5 inches is seated at its trailing end in a sewn-in pocket 31 positioned at the trailing edge of the sail, with the leading end of the intermediate longitudinal brace member being attached to the remaining ends of the lateral brace members by suitable means. Such a wing has a sweep angle beta of about 25 degrees, a dihedral angle alpha of about 15 degrees and an aspect ratio (as hereafter defined) of 1.9. The wing also has a camber height of 1.5 inches.

An alternative embodiment consists of a sail fabric (not depicted) which is delta-shaped in configuration, having a longitudinal dimension (or cord length) of approximately 11.5 inches at center, a tip to tip dimension of approximately 41 inches, and a line drawn from tip to tip passing approximately 11.5 inches rearward of the foremost leading edge of the sail. This embodiment has a sweep angle beta of about 30 degrees, a dihedral angle alpha of about 20 degrees, and an aspect ratio (as hereafter defined) of 3.6. The wing has a camber height of approximately one inch.

As depicted in the Figures, the means of attachment of the intermediate longitudinal brace member to the lateral brace members comprises a preformed or precut block 13 of a thermoplastic resin such as Delrin of such configuration so as to encourage or urge the formation of the desired dihedral and sweep back angles and the accompanying self-induced camber. The manner by which the longitudinal and lateral brace members are inserted into the preformed or precut block also ensures that the longitudinal brace member and lateral brace members do not reside within the same plane (as indicated by the existence of the dihedral angle).

Figure 6:
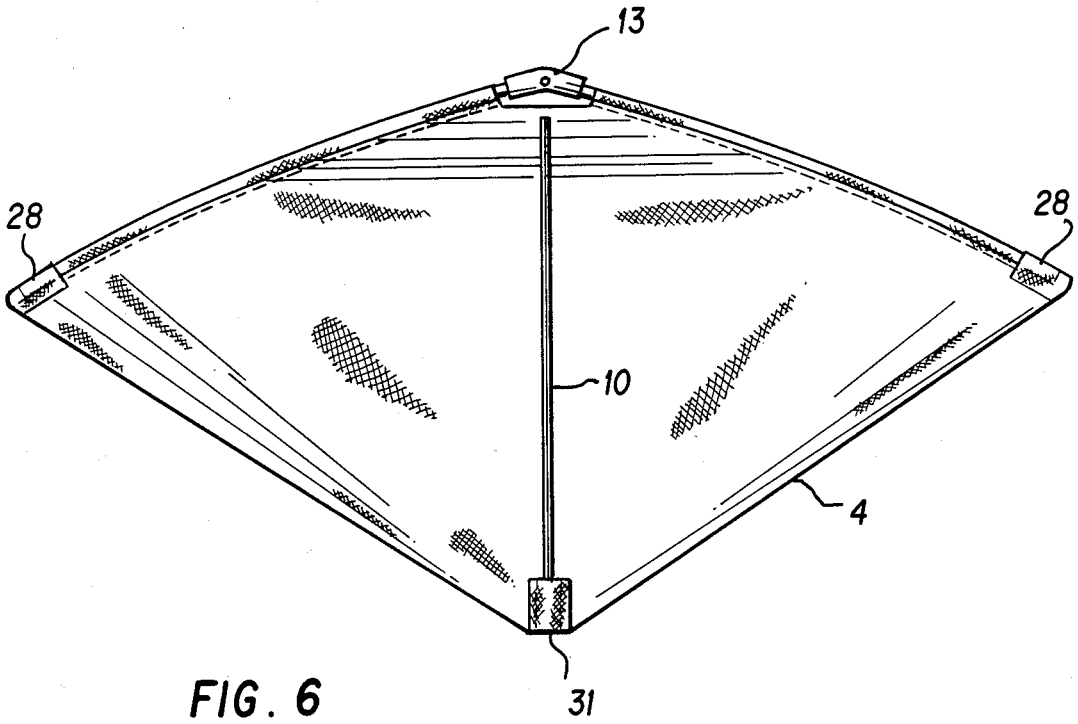
FIG. 6 is a bottom view of the embodiment of FIG. 1 in a state of partial assembly.

The formation of the self-induced camber within the wing is also somewhat dependent upon the length of the intermediate longitudinal brace member 10 in relation to the longitudinal length of the sail as well as the manner by which the longitudinal brace member is attached to the lateral brace members 7. That is, once (a) the longitudinal brace member 10 is seated within the sewn-in pocket 31 in the trailing edge of wing, (b) the lateral brace members are seated within the sewn-in pockets 28 in the respective lateral edges of the sail and connected to one another via predrilled holes in the preformed block and (c) the wing placed flat on a surface, the longitudinal brace member and the preformed block must cooperate to induce the formation of the requisite camber. As depicted in FIG. 6, the premolded block is configured such that the intermediate longitudinal brace member cannot be inserted into a predrilled hole in the block without the block being rolled in a direction toward the rearward portion of the wing to position the predrilled hole adjacent the unattached end of the intermediate longitudinal brace member.

Figure 7:
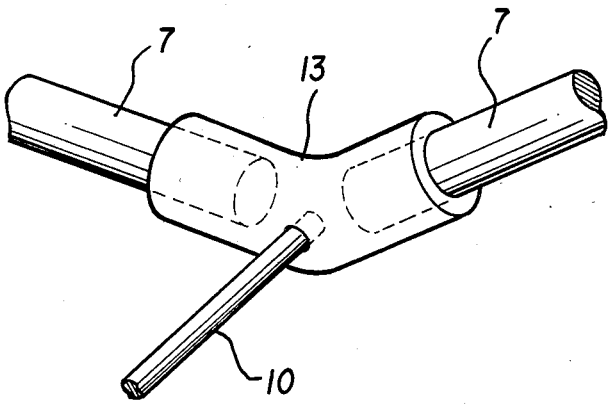
FIG. 7 is a detail view of the attachment means used to connect the lateral and longitudinal brace members in the embodiment of FIG. 1.

During one method of fabrication the sail fabric is cut and stitched in a manner which enables the sail to be stretched across the supporting structure while retaining a smooth upper surface to enhance the ability of the wing to serve as an airfoil. The sail will otherwise not lay flat in a disassembled state as shown in FIG. 6. FIG. 6 depicts the wing of FIGS. 1–5 in a partially assembled state with the Figure demonstrating that the leading centrally-disposed portion of the sail does not lay flat when the wing is in such a disassembled state. However, once the longitudinal member is inserted into the preformed block that portion of the fabric will be stretched tight across the frame. The longitudinal brace member 10 must be of a length sufficient to permit its attachment to the preformed block once the block and the leading edge of the wing are rolled or curled downwardly toward the leading unattached end of the longitudinal brace member while providing the requisite tensioning of the wing. Once such attachment occurs, the self-induced camber 34 will inherently be formed as a result of such rolling or curling of the leading edge of the wing downwardly in relation to the lateral ends of the wing in the manner depicted by the arrow of FIG. 5. The amount of camber can be enhanced by the shortening of the longitudinal brace member to a length which requires that the leading edge of the wing be rotated downwardly to a greater extent to permit attachment of the preformed block to the longitudinal brace member. FIG. 7 depicts the attachment of the lateral brace members and the intermediate longitudinal brace member via the preformed block 13.

Such manner of formation of the improved sail of the present invention results in the tensioning of the various members of the supporting structure of the wing. For example, the rolling or curling under of the leading edge of the wing in a manner suitable to permit attachment of the leading edge of the longitudinal supporting brace member to the premolded block results in the lateral brace members 7 being drawn rearwardly in a manner indicated by the arrows in FIG. 2 as well as upwardly in a manner indicated by the arrows in FIG. 4 resulting in the formation of the requisite dihedral angle.

In a second method of formation of the sail (not depicted) two mirror-imaged halves are provided whose attachment results in a seam along the longitudinal axis of the wing. The respective halves are attached to both the front and rear portions of the untensioned frame, leaving the center unsewn. The frame is then placed under tension and the respective halves sewn together in a manner sufficient to obtain the designed camber. Such a method may also be employed with advantage to vary the location of the induced camber along the longitudinal axis of the wing.

Figure 8:
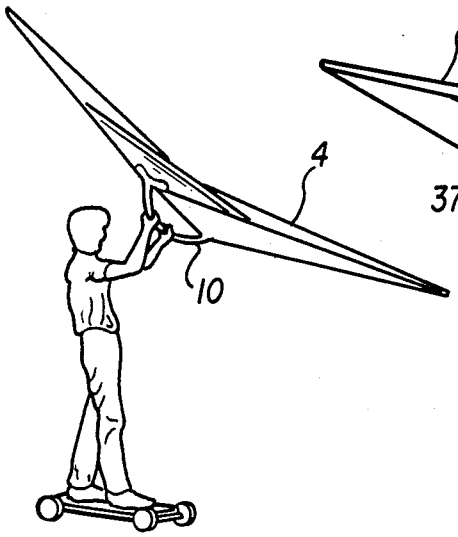
FIG. 8 is a view in perspective of a hand-held wind sail comprising the embodiment of the improved wing of the present invention depicted in FIG. 1.

The improved wing of the present invention may be employed in various environments in view of its general applicability as a sail. As depicted in FIG. 8, intermediate longitudinal brace member 10 may comprise a linear control bar adapted for holding by a person wishing to be propelled, e.g., on a skateboard or surfboard (not depicted). Such a hand-held wing is employed by directing a sufficient portion of the leading edge of the wing into the wind in a manner and at an angle of attack sufficient to result in the desired lift and propulsion.

Figure 9:
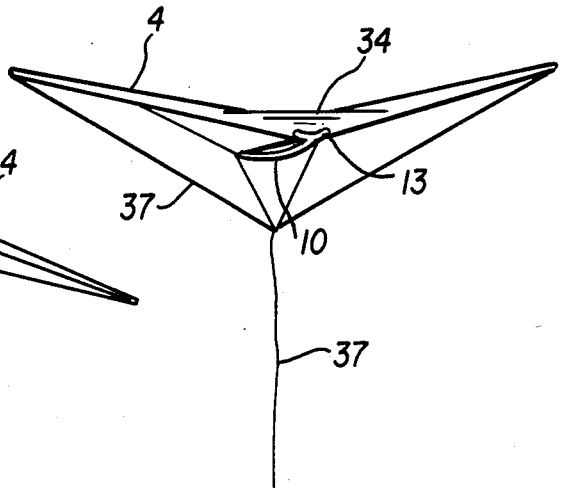
FIG. 9 is a view in perspective of a kite comprising the embodiment of the improved wing of the present invention depicted in FIG. 1.

Alternatively, the improved wing of the present invention may be employed as a kite as depicted in FIG. 9. String control means 37 are connected to the respective lateral, leading and trailing edges of the wing, with the wing then being able to be flown in the same manner as a conventional kite.

While not depicted, the wing of the present invention can also be readily adapted for use with ultralight aircraft in view of the dihedral characteristics of the wing. The wing may also be employed with advantage with radio-controlled gliders as depicted in FIGS. 11 and 12 which gliders are similar to the hand-tossed glider depicted in FIG. 10 but with the additional presence of radio-controlled means mounted in a leading or nose portion of the fuselage 38 positioned within the fuselage to control the vertical and horizontal control surfaces 22, 25 at the tail end of the fuselage via cable connections 40 connected to said surfaces.

Figure 12:
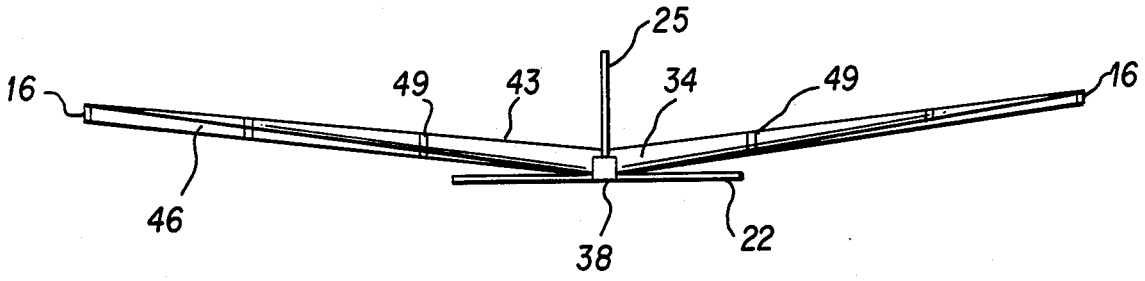
FIG. 12 is a front view of the embodiment of FIG. 11.

FIGS. 11 and 12 depict a radio-controlled glider which includes a wing having a self-induced camber having lateral brace members 7,7', laterally disposed longitudinal brace members 16 and intermediate longitudinal brace member 10. In the embodiment disclosed the wing includes both a first fabric portion 43 which serves as the upper surface of the wing and a second fabric portion 46 which serves as the lower surface of the wing. The second fabric portion is disposed below the first fabric portion and is stretched across the supporting structure in a substantially planar manner. A self-induced camber 34 is provided in the first fabric portion in accordance with the present invention.

In a preferred embodiment, the respective fabric portions have sewn therein longitudinally oriented supporting members or battens 49 which serve to stabilize the wing structure. Such supporting members are flexible by nature and are not intended to induce the formation of any shape in the wing. The battens are of a length such that they preferably can be wrapped around the leading edge of the wing with the respective ends terminating at the trailing edge of the wing. Such battens can be comprised, for example, of polystyrene plastic strips ½ inch wide and 1/16–1/32 inch in thickness when used with gliders. In the alternative, a heavy sail fabric or cloth can be used which would inherently provide enhanced physical stability. In the embodiment of FIG. 11, the trailing edge of the sail extends rearwardly of the lateral brace members 7' in contrast to the manner in which the sail conforms to the supporting frame in FIG. 10.

A typical radio-controlled glider as depicted in FIGS. 11 and 12 has a flying weight of 27.5 ounces, a wing area of 3.4 ft.$^2$, a wing span of 61 inches, a wing aspect ratio of 7.35, a fuselage length of 33 inches, a tail group length of 17.75 inches, a mid-wing cord length of 8.25 inches, a wing tip cord length of 8.75 inches, an elevator width (rear) of 12.75 inches, a rudder height of 6.75 inches and a nose length of 5.75 inches. The sail fabric comprises 1.5 ounce ripstop nylon. The frame consists of ¼ and 3/16 inch diameter fiberglass rods in the wing and 3/16 to ⅛ inch diameter fiberglass rods in the tail. All fittings connecting the frame members are Delrin plastic fittings. The sail battens and the control surfaces are polystyrene.

The relative aspect ratio of the wing of the present invention affects the performance characteristics of the wing. The aspect ratio is defined as the ratio of span to cord, with the span being the distance from wing tip to wing tip and the cord being the longitudinal length of the wing at center. Kite wings have been found to function satisfactorily with aspect ratios of from about 1:1 to 7:1, while glider wings have been found to operate satisfactorily at aspect ratios of from about 5:1 to 7:1. However, the aspect ratio may be varied to suit the flight characteristics desired. Glider wings generally require a greater aspect ratio than do kite wings to enhance the performance of the wing while reducing drag.

The detailed description set forth is the preferred embodiment of the method of the present invention. However, certain changes may be made in carrying out the above method without departing from the scope of the invention; it is therefore intended that all matter contained in the above description shall be interpreted as illustrative and not in a limited sense. It is also to be understood that the following claims are intended to cover all of the generic and specific features of the invention herein described, and all statements of the scope of the invention, which as a matter of language, might be said to fall therebetween.

What is claimed is:

1. An improved wing having a self-induced camber comprising an aerodynamic dihedral sail structure having a fabric sail tensioned on a supporting frame, said supporting frame comprised of opposing elongated lateral brace members along the leading edge of the wing and an elongated longitudinal brace member positioned intermediate the ends of the lateral braces, first ends of said lateral brace members and a first end of said longitudinal brace member being attached to one another at a common terminus centrally positioned along the leading edge of the wing to define a fixed dihedral angle, the leading edge of said fabric sail being attached to said lateral brace members and a rearwardly disposed portion of said sail being attached to a rearwardly disposed second end of said longitudinal brace member, with said sail extending between laterally disposed second ends of said lateral brace members and said rearwardly disposed second end of said longitudinal brace member, said lateral and longitudinal brace members being so attached to one another and said sail being so configured and caused to be tensioned over said brace members whereby a dihedral sail is formed having a self-induced camber portion intermediate the laterally disposed ends of the lateral brace members and centrally positioned along only a portion of the leading edge of the wing.

2. The wing of claim 1 wherein said dihedral angle of the wing ranges from greater than 0 up to about 45 degrees.

3. The wing of claim 2 wherein said dihedral angle ranges from about 5 to 20 degrees.

4. The wing of claim 1 wherein said lateral brace members and said longitudinal brace member are comprised of fiberglass.

5. The wing of claim 1 wherein the lateral ends of said sail are disposed rearwardly from a centrally disposed leading edge of said sail.

6. The wing of claim 1 wherein said intermediate brace member comprises a linear control bar capable of being hand-held.

7. The wing of claim 1 wherein the maximum lateral dimension of the sail exceeds the maximum longitudinal dimension of the sail.

8. The wing of claim 1 wherein said fabric is comprised of a synthetic material.

9. The wing of claim 8 wherein said synthetic material is selected from the group consisting of nylon, polyester and polyethylene.

10. The wing of claim 1 wherein said self-induced camber extends from the point of attachment of said intermediate longitudinal brace member to said lateral brace members to a point at least approximately one-third to one-half the distance to the lateral ends of the leading edges of said wing.

11. The wing of claim 1 having a sweep angle of from about 0 to 60 degrees.

12. The wing of claim 11 wherein said sweep angle ranges from about 25 to 45 degrees.

13. The wing of claim 1 wherein said first ends of said lateral brace members and said first end of said longitudinal brace member are attached to one another by means of a preformed fitting into which each of said first ends is inserted, said fitting being configured to result in the formation of said dihedral angle upon insertion of said lateral brace members and said fitting and said longitudinal brace member cooperating to result in the formation of said self-induced camber portion upon insertion of said longitudinal brace member into said fitting.

14. The wing of claim 1 wherein portions of said sail which are laterally adjacent to said self-induced camber portion are substantially planar in configuration.

15. An improved wing having a self-induced camber comprising an aerodynamic dihedral sail structure having a fabric sail tensioned on a supporting frame, said supporting frame comprised of elongated opposing first and second pairs of lateral brace members and an elongated longitudinal brace member positioned intermediate first ends of the lateral brace members, the lateral brace members of said first opposing pair being positioned along the leading edge of the wing and attached to a forwardly disposed portion of said longitudinal brace member at a common terminus centrally positioned along the leading edge of the wing with the lateral brace members of the second pair being attached to a rearwardly disposed portion of said longitudinal brace member, the remaining ends of said lateral brace members being connected to one another by laterally disposed longitudinal brace members, said fabric sail being attached to said lateral brace members along their lateral extent, said sail being so configured and said elongated intermediate longitudinal brace member and said lateral brace members being attached in a manner whereby said sail is caused to be tensioned over said supporting structure in a manner sufficient to result in the formation of a dihedral sail having a self-induced camber portion intermediate the laterally disposed ends of the sail and centrally positioned along only a portion of the leading edge of the wing.

16. The wing of claim 15 wherein said dihedral angle of the wing ranges from greater than 0 up to about 45 degrees.

17. The wing of claim 16 wherein said dihedral angle ranges from about 5 to 20 degrees.

18. The wing of claim 15 wherein said lateral brace members and said longitudinal brace members are comprised of fiberglass.

19. The wing of claim 15 wherein the maximum lateral dimension of the sail exceeds the maximum longitudinal dimension of the sail.

20. The wing of claim 15 including an elongated fuselage member attached to said intermediate longitudinal brace member.

21. The wing of claim 20 wherein said fuselage portion includes vertically and horizontally disposed flight stabilizing surfaces located at the trailing end thereof.

22. The wing of claim 15 wherein said fabric is comprised of a synthetic material.

23. The wing of claim 22 wherein said synthetic material is selected from the group consisting of nylon, polyester and polyethylene.

24. The wing of claim 15 further comprising a fabric portion disposed below said fabric sail and stretched across said supporting structure in a substantially planar manner.

25. The wing of claim 15 having a sweep angle of from about 0 to 60 degrees.

26. The wing of claim 25 wherein said sweep angle ranges from about 25 to 45 degrees.

27. The wing of claim 21 further including radio-controlled means adapted to permit control of said vertically and horizontally disposed flight stabilizing surfaces.

28. The wing of claim 15 wherein portions of said sail which are laterally adjacent to said self-induced camber portion are substantially planar in configuration.

* * * * *